US010287792B2

(12) United States Patent
Stokes, Sr. et al.

(10) Patent No.: US 10,287,792 B2
(45) **Date of Patent: *May 14, 2019**

(54) SUSPENSION LIFT

(71) Applicants: Van Stokes, Sr., Delray Beach, CA (US); Van Stokes, Jr., Miami, FL (US)

(72) Inventors: Van Stokes, Sr., Delray Beach, CA (US); Van Stokes, Jr., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/037,585

(22) Filed: Jul. 17, 2018

(65) Prior Publication Data

US 2018/0320399 A1 Nov. 8, 2018

Related U.S. Application Data

(63) Continuation of application No. 15/071,284, filed on Mar. 16, 2016.

(60) Provisional application No. 62/136,665, filed on Mar. 23, 2015.

(51) Int. Cl.
*B66F 7/02* (2006.01)
*E04H 6/06* (2006.01)

(52) U.S. Cl.
CPC ..... *E04H 6/06* (2013.01); *B66F 7/02* (2013.01)

(58) Field of Classification Search
CPC ..... E04H 6/06; B66F 7/02; B66F 7/00
See application file for complete search history.

(56) References Cited

U.S. PATENT DOCUMENTS 3,435,915 A * 4/1969 Villars ..... B66F 7/02 187/209
6,446,757 B1 9/2002 Taylor
7,143,869 B1 * 12/2006 Chance ..... B66F 7/04 187/208
7,228,939 B1 6/2007 Prater
8,297,410 B2 * 10/2012 McDonald ..... B66F 7/04 187/213
2008/0121853 A1 * 5/2008 Schultz ..... B66F 7/28 254/264
2009/0321189 A1 12/2009 Schmitt

FOREIGN PATENT DOCUMENTS

FR 1093591 A * 5/1955 ..... B66F 7/02
FR 2343688 A1 10/1977
FR 2487803 A1 2/1982
GB 1102586 A 2/1968
WO 2015178870 A1 11/2015

OTHER PUBLICATIONS

Office Action for corresponding U.S. Appl. No. 15/071,284, 14 pages, dated Dec. 14, 2017.

* cited by examiner

*Primary Examiner* — Diem M Tran

(74) *Attorney, Agent, or Firm* — Timothy X. Gibson; Gibson & Dernier LLP

(57) ABSTRACT

A suspension lift apparatus includes a platform, a plurality of direction changing sheaves and lifting sheaves mounted to the platform, a plurality of cables and a lifting mechanism positioned on the platform. Ends of cables mounted above the platform extend through the sheaves and are coupled at the opposite cable ends to the lifting mechanism disposed on the platform. Actuation of the lifting mechanism causes the platform to rise or descend. The cables are anchorable to a structure such as a ceiling above the platform. The suspension lift apparatus may include legs to provide an overhead anchor point.

8 Claims, 13 Drawing Sheets

SUSPENSION LIFT

CROSS-REFERENCE TO RELATED APPLICATIONS

This application is a continuation of U.S. patent application Ser. No. 15/071,284 filed Mar. 16, 2016, which claims the benefit of U.S. Provisional Patent Application No. 62/136,665 filed Mar. 23, 2015, the entireties of which are incorporated herein by reference.

FIELD OF THE INVENTION

The invention relates to lifts for automobiles and in particular, suspension lifts for automobiles.

BACKGROUND

Parking lifts are useful in stacking cars to be parked to maximize the space available for parking in a parking deck or lot. Lift mechanisms and hydraulics are typically located in a supporting structure or ceiling, requiring additional structural components and consuming valuable space that could otherwise be used for parking automobiles.

SUMMARY OF THE INVENTION

There is a need in the art for an automobile lift assembly that reduces structure and conserves space. Provided herein are embodiments of a suspension lift including a lifting mechanism and hydraulics within the platform of the lift apparatus eliminating the need for additional structure to house the lifting mechanism.

In accordance with an embodiment a suspension lift is disclosed having a platform, direction changing sheaves and lifting sheaves mounted to the platform, cables and a lifting mechanism positioned on the platform. Ends of cables mounted above the platform extend through the sheaves and are coupled at the opposite cable ends to the lifting mechanism disposed on the platform. Actuation of the lifting mechanism causes the platform to rise or descend. In accordance with one or more embodiments the cables are anchored to a structure such as a ceiling above the platform.

In accordance with further embodiments, a suspension lift apparatus includes a vehicle platform having a front and rear end, opposing sides between the front and rear end and a central channel formed on the platform along a long axis of the platform, the platform having a plurality of sheaves mounted on a periphery of the platform, a lifting mechanism coupled to the platform and positioned in the channel in axial alignment and coplanar therewith, and a plurality of cables, each of the plurality of cables fixed at a first end to a first end of the lifting mechanism, and routed through the sheaves such that a second end of each cable is operable to be fixed to a structure above the platform, wherein the lifting mechanism is operable to advance the plurality of cables in a first direction to lower the platform relative to the structure above the platform and retract the plurality of cables in a second, opposite direction to raise the platform toward the structure.

The lifting mechanism may include a hydraulic cylinder, motorized or mechanical jack or the like suitable for extending and/or retracting a plurality of cables coupled thereto. The suspension lift may include a lifting block having a first side coupled to respective first ends of the plurality of cables and an opposite side coupled to the lifting mechanism. The suspension lift may include a latch to retain the cables in one or more fixed positions. In one or more embodiments the latch is operable to prevent the lifting mechanism from moving the cables. The lifting block may include at least one such latch. The latch may be pivotably mounted on the lifting block. The lifting block may include two or more latches coupled with a retention plate to ensure coordinated pivotable movement of the latches. The suspension lift may include at least one latch stop block with which the at least one latch is operable to engage. The suspension lift may further include a latch release mechanism pivotably coupled to the at least one latch stop block A latch release mechanism may be coupled to the latch and may be electrically operable by one or more electric solenoids or the like for operating the latch release mechanism. The latch release mechanism may be coupled to a Bowden wire and knob or the like to enable an operator to apply a pulling force on the latch release mechanism. The safety latch assembly may include a spring to provide a biasing force to return the latch release mechanism to the lowered position.

A cover may be provided to cover the channel, thereby forming a housing serving to protect the lifting mechanism, safety latch and cables positioned therein. The channel and cover may be configured so that its highest height, measured from the floor of the platform in the area of the platform runways to the top surface of the cover, is below the minimum ground clearance of a standard automobile. This height may be greater given the particular application, for example, heavy duty trucks, etc. In some embodiments the combined height of the channel and cover relative to a bottom floor portion of an adjacent wheel runway is only sufficient to permit clearance of a vehicle body bottom when the vehicle is in a parked position on the platform. The phrase "only sufficient to permit clearance of a vehicle body bottom" as used herein means that the maximum clearance between a top surface of the channel cover and the bottom surface of a vehicle body positioned on the platform, with the wheels of the vehicle on the platform runways in a parked position, is from 0.5 to 4 inches, preferably 1 to 3 inches, and more preferably, 2 inches.

The platform may include at least one drive on ramp, wheel stop and wheel runways. Parallel runways may be defined by curbs positioned longitudinally along the platform periphery and the cover covering the channel. The runway curbs are used to confine the passage of vehicle tires in the runways and direct the vehicles onto the platform straightaway and are sized, dimensioned and positioned so that they keep an automobile substantially centered on the platform. In some embodiments the curbs are of such a width that the mirrors and other parts of the car that extend beyond the outside walls of the tire do not extend beyond the platform edge. This allows placement of adjacent lifts close together, conserving space from side to side, without hitting the mirrors of adjacent cars.

In one embodiment a drive-on ramp is disposed at an entrance end of the platform and may have sloped front and back ends so that as a car is driven onto the platform and onto the runway the sloped back end serves as a block to prevent the car rolling off the entrance end of the platform. A wheel stop at the platform end opposite the entrance end is dimensioned to house direction changing sheaves and upright lifting sheaves for that end of the platform. It will be apparent to those skilled in the art that drive on ramps may be disposed at either or both ends of the platform, as in some cases it may be desirable to accommodate entrance and exit of a car from either end of the platform.

The thickness of the platform employed in some embodiments is from about 2 mm to about 10 mm. This allows the wheels of the vehicle to be parked on the very bottom of the platform. Employing a minimal platform thickness, such as 2 mm, permits a reduction of space between the raised platform and a car parked beneath the platform.

In accordance with still further embodiments a suspension lift apparatus includes a vehicle platform having a front and rear end, opposing sides between the front and rear end and a central channel formed on the platform along a long axis of the platform, the platform further including a first pair of sheaves mounted on opposing sides of the platform vertically with respect to a horizontal plane of the platform and in axial alignment with the long axis of the platform, and positioned between the front and rear ends of the platform, a second pair of sheaves mounted on opposing sides of the platform coplanar with the platform, the second pair of sheaves positioned adjacent the rear end of the platform, a third pair of sheaves mounted at opposing sides of the platform vertically with respect to the horizontal plane of the platform and in axial alignment with a short axis of the platform, a fourth pair of sheaves mounted adjacent each other at an end of the channel proximate the rear end of the platform, each of the fourth pair of sheaves mounted coplanar with the platform, and a fifth pair of sheaves mounted in axial alignment with the fourth pair of sheaves; a lifting mechanism coupled to the platform and positioned in the channel in axial alignment therewith; and two pairs of cables, each cable of said pairs of cables coupled at a first end to a first end of the lifting mechanism, wherein one cable of a first pair of cables is routed around one of the fourth pair of sheaves, one of the second pair of sheaves and one of the first pair of sheaves and includes a second end fixable to a structure above the platform, and the other cable of the first pair is routed around the other of the fourth pair of sheaves, the other of the second pair of sheaves and the other of the first pair of sheaves and includes a second end fixable to a structure above the platform, and wherein one cable of a second pair of cables is routed around one of the fifth pair of sheaves and one of the third pair of sheaves and includes a second end fixable to a structure above the platform, and the other of the second pair of cables is routed around the other of the fifth pair of sheaves and the other of the third pair of sheaves and includes a second end fixable to a structure above the platform.

In accordance with an embodiment, one of the first pair of sheaves is mounted to a curb on a first side of the platform and the other of the first pair of sheaves is mounted to a curb on the opposing side of the platform. The platform may include at least one end plate extending vertically with respect to the horizontal plane of the platform and orthogonal to the opposing sides. In some embodiments each one of the third pair of sheaves is mounted to an end plate extending vertically with respect to the horizontal plane of the platform and orthogonal to the opposing sides. The suspension lift apparatus may include a lifting block having a first side coupled to the two pairs of cables and an opposite side coupled to the lifting mechanism. The lifting mechanism may include a reciprocally movable extension arm having an end coupled to the lifting block.

In other embodiments, when there is no ceiling or other support available to anchor one or more of the cables, the suspension lift may include one or more legs having a base and one or more cable mounts at an end opposite the base. The legs may be integrated with curbs at the periphery of the platform and be configured very thin to conserve space. Additionally, the number of cables and number of mounting points and/or legs may vary depending on the size of the platform. Thus, embodiments of suspension lifts disclosed herein may include at least one leg positioned adjacent the platform, the at least one leg comprising at least one cable mount to receive a second end of at least one of the cables. For example, but not by way of limitation, the suspension lift apparatus may include four legs, each leg having at least one cable mount to receive a second end of at least one of the cables.

Embodiments of the present disclosure provide a suspension lift that is lighter in weight than any available parking lift. In addition to providing a compact sized parking lift, the disclosed embodiments provide a major cost savings at least insofar as the material requirements, such as steel, are minimized.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE INVENTION

Figure 1:
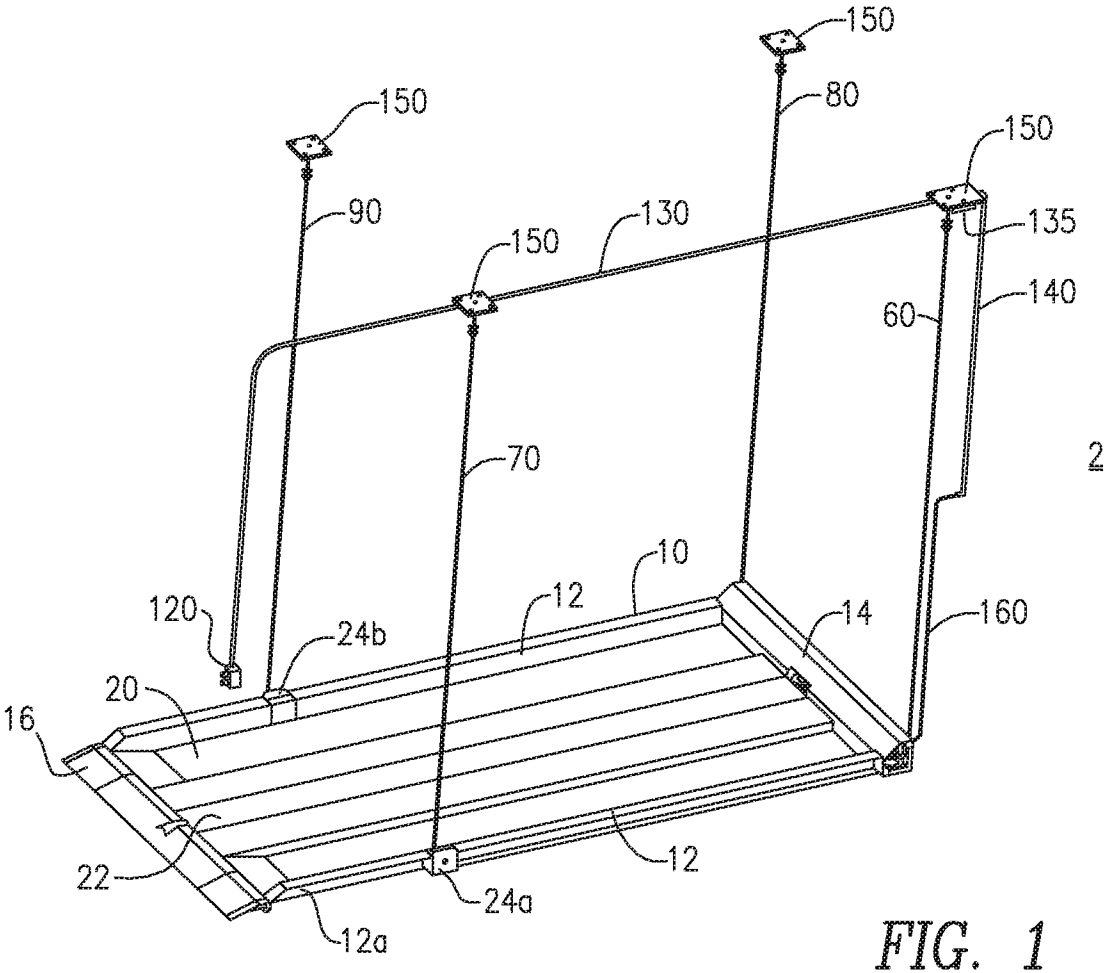
FIG. 1 is an elevated perspective view of a suspension lift in a lowered position in accordance with an embodiment of the present disclosure.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
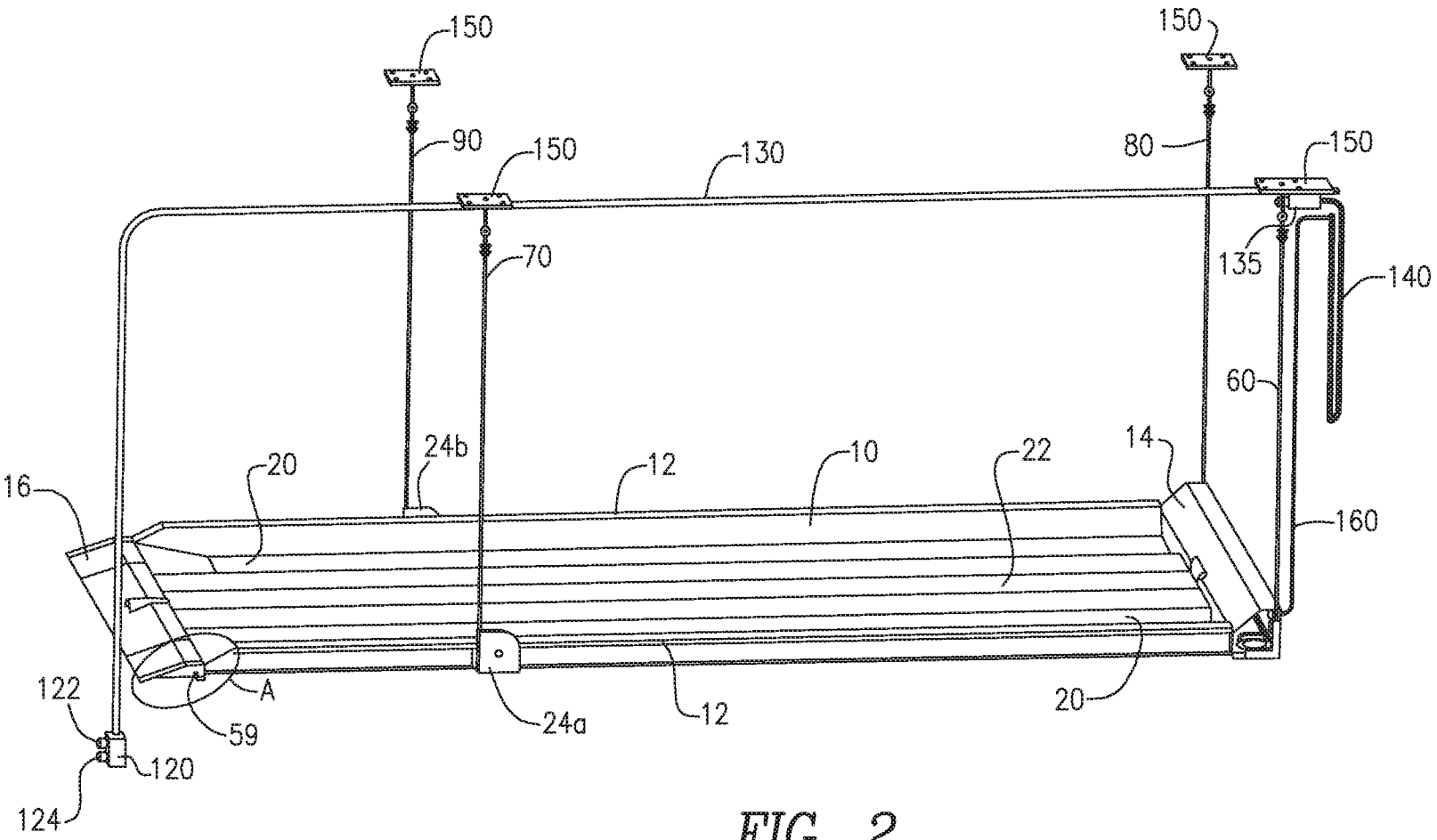
FIG. 2 is an elevated perspective view of a suspension lift in a raised position in accordance with an embodiment of the present disclosure.
Figure 3:
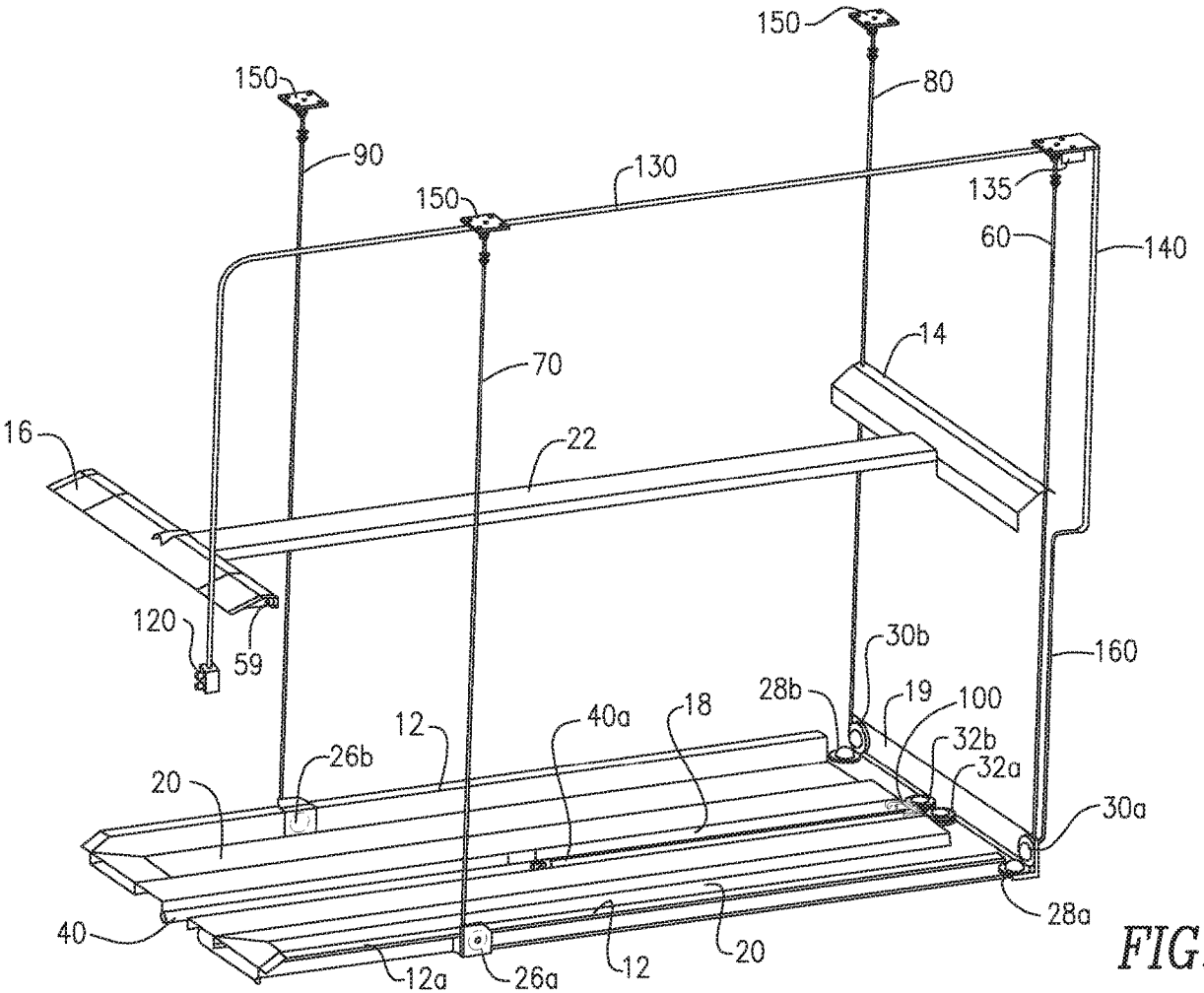
FIG. 3 is an elevated partially exploded perspective view of a suspension lift in a lowered position with a channel cover, drive-on ramp and wheel stop removed from the platform in accordance with an embodiment of the present disclosure.
Figure 5:
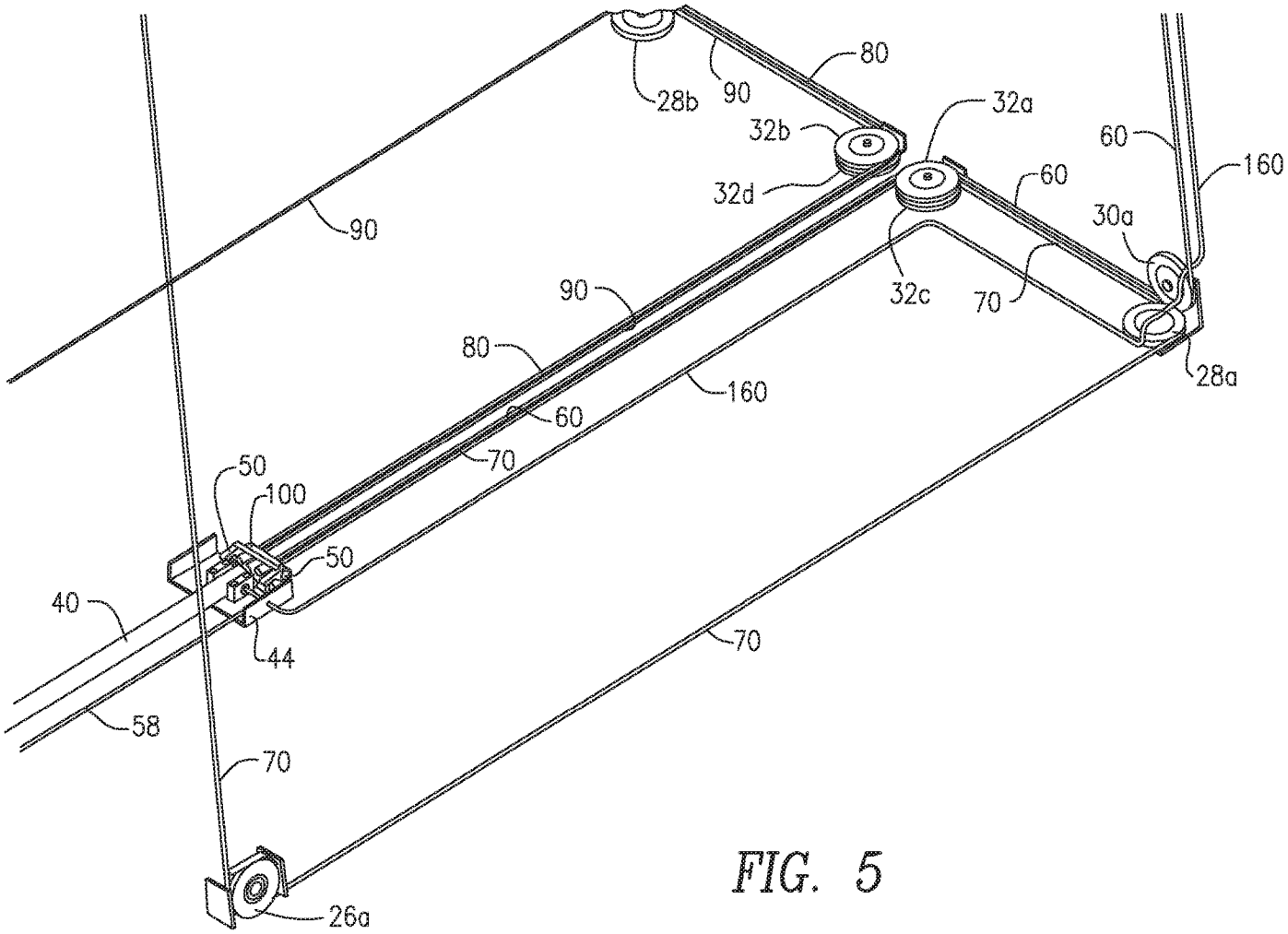
FIG. 5 is a schematic elevated perspective detailed view of a portion of a lifting mechanism, cable and sheave arrangement of a suspension lift in accordance with an embodiment of the present disclosure.

Embodiments of the present invention will now be described with reference to the FIGS. With reference to FIGS. 1-3, in accordance with an embodiment a suspension lift 2 is disclosed having a platform 10 suspended from cables 60, 70, 80 and 90, each fixed at a first end to an anchor 150, and at a second end to a lifting block 100. The lifting block 100 is coupled to a lifting mechanism 40 positioned on the platform 10. The lifting mechanism 40 may be any suitable lifting mechanism known in the art such as but not limited to a hydraulic cylinder, motorized jack or the like. Actuation of the lifting mechanism 40 causes the platform to rise from a lowered position (FIG. 1) to a raised position (FIG. 2) and vice versa. In accordance with one embodiment, a control box 120 is operably coupled to a valve block 135 via electrical cable 130. Valve block 135 may be positioned in any suitable location, such as but not limited to adjacent or on an anchor 150. The control box 120 may be any suitable control box, and include controls such as UP and DOWN buttons, etc. The valve block 135 includes one or more valves for controlling flow of hydraulic fluid. The valve block 135 may be and/or include any suitable commercially available hydraulic control valve(s), such as but not limited to a solenoid-operated, 2-way, normally open, poppet-type, screw-in hydraulic cartridge valve available from HydraForce Hydraulics Ltd. of Lincolnshire, Ill. One skilled in the art will recognize the type of valve or valves employed in valve block 135 may depend on space considerations, load demand, etc. The valve block 135 is coupled to a hydraulic pumping unit (not shown) and in some cases an electrical power source (not shown) to operate the valve(s) of the valve block 135. Valve block 135 is further coupled to a flexible hose 140. Flexible hose 140 may in some embodiments be a single hydraulic hose, while in other embodiments the flexible hose 140 may contain a hydraulic hose as well as electrical wiring, if necessary. Flexible hose 140 is coupled to pipe 160, wherein the flexible hose 140 can fold upon itself as the platform 10 is raised. The flexible hose 140 is of sufficient flexibility to fold as the platform 10 is raised. With further reference to FIG. 5, pipe 160 is routed to lifting mechanism 40 to supply hydraulic fluid or electrical power, depending on the type of lifting mechanism 40 employed. It will be apparent to those skilled in the art that the pipe 160 may be formed of any material typically used to protect the contents thereof, such as hydraulic fluid or wiring, from the surrounding environment. The pipe 160 may be rigid or flexible, and constructed of metal, plastic, fiber, etc.

In embodiments in which the lifting mechanism 40 is a hydraulic lifting mechanism, the pipe 160 serves as a hydraulic line. In other embodiments, in which the lifting mechanism 40 is not hydraulic, such as but not limited to a motorized jack, the flexible hose 140 and the pipe 160 may contain only wiring.

The platform 10 may include a wheel stop 14, drive on ramp 16, longitudinal channel 18 and wheel runways 20 disposed longitudinally on the platform 10. Longitudinal channel 18 is sized and configured to contain the lifting mechanism 40, lifting block 100 and portions of cables 60, 70, 80 and 90. Runways 20 may be defined by curbs 12 positioned longitudinally along the platform 10 periphery and channel cover 22. Channel cover 22, wheel stop 14 and drive-on ramp 16, as shown in FIG. 3, may be removable to provide access to components of the suspension lift 2 which are covered by channel cover 22, wheel stop 14 and drive-on ramp 16 during use, so that such components may be serviced, replaced, etc.

Figure 4:
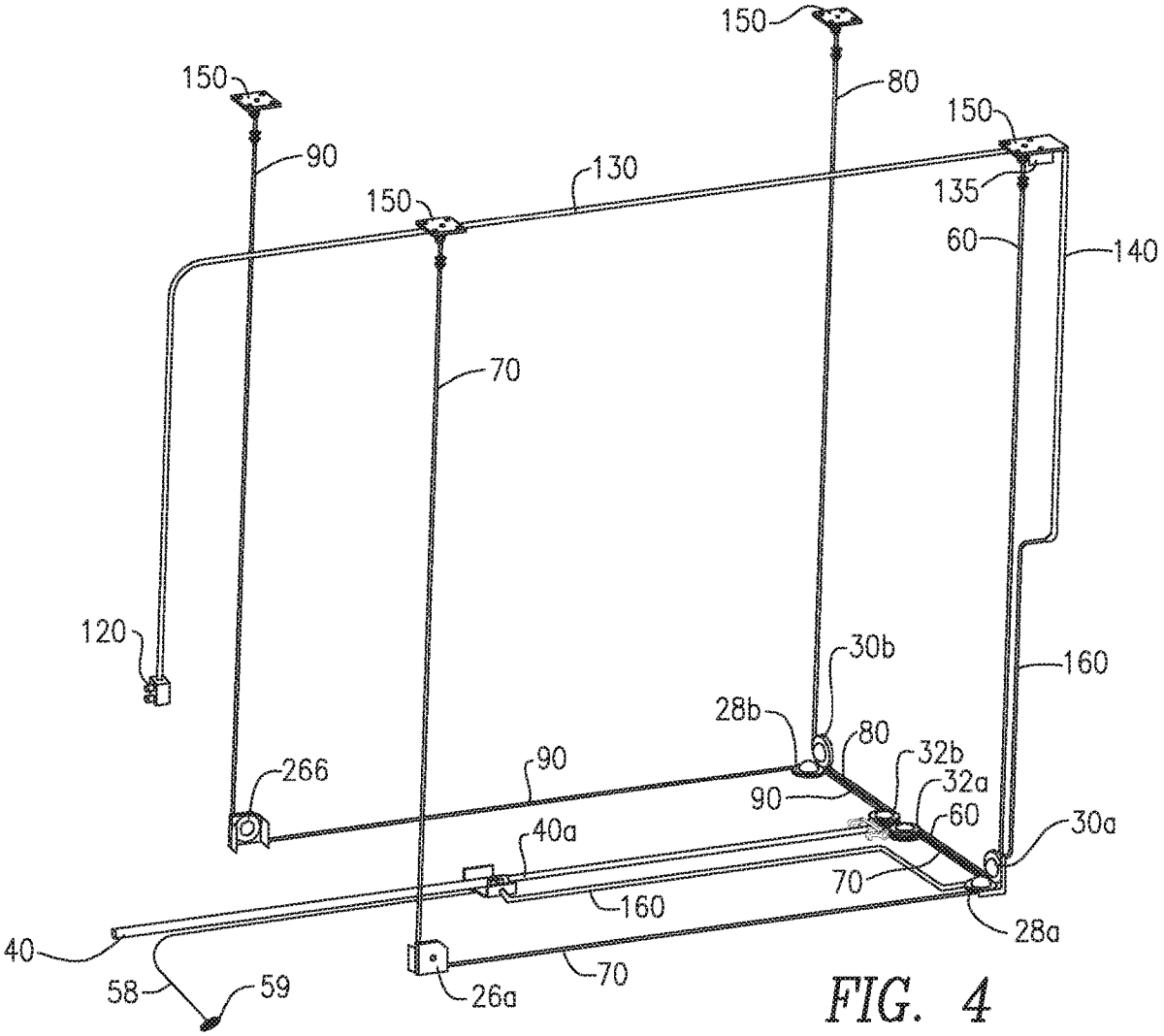
FIG. 4 is a schematic elevated perspective view of a lifting mechanism, cable and sheave arrangement of a suspension lift in a lowered position in accordance with an embodiment of the present disclosure.
Figure 6:
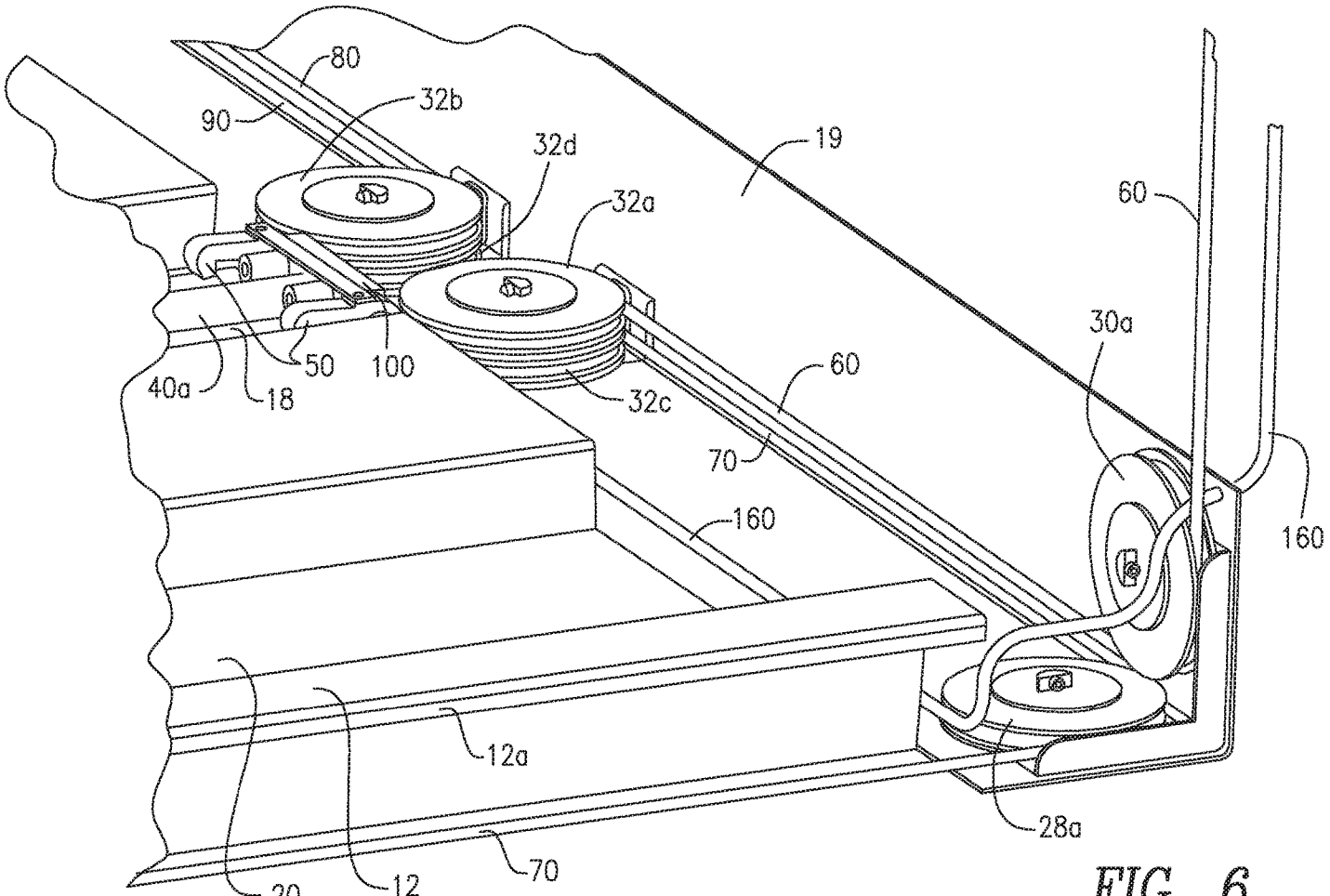
FIG. 6 is an elevated perspective view of a corner of a platform of a suspension lift depicting a cable and sheave arrangement in accordance with an embodiment of the present disclosure.

With further reference to FIGS. 4-6, vertical lifting sheaves **26*a* and 26*b* are rotatably mounted opposite each other on the periphery of the platform. Sheave plates 24*a* and 24*b* may be mounted to the platform 10 to protect vertical lifting sheaves 26*a* and 26*b*. Outer horizontal direction-changing sheaves 28*a* and 28*b* are rotatably mounted opposite each other on a floor of the platform 10 adjacent end plate 19. Vertical lifting sheaves 30*a* and 30*b* are rotatably mounted on the end plate 19** opposite each other. A first set of inner horizontal direction-changing sheaves

32*a* and 32*b* are rotatably mounted to the floor of platform 10 adjacent end plate 19. A second set of inner horizontal direction-changing sheaves 32*c* and 32*d* are rotatably mounted to the floor of platform 10 adjacent end plate 19, positioned between the floor and sheaves 32*a* and 32*b* and substantially coplanar therewith. As will be apparent to those skilled in the art, in some embodiments respective pairs of inner horizontal direction-changing sheaves 32*a* and 32*c*, 32*b* and 32*d* may be formed as a single unit. In other embodiments these sheaves may be separate sheaves to permit independent rotation thereof. Wheel stop 14 is sized and configured to fit over the sheaves 28*a*, 28*b*, 30*a*, 30*b*, 32*a*, 32*b*, 32*c* and 32*d*.

Cable 60 is coupled at a first end to an anchor 150, routed through sheaves 30*a* and 32*a* and coupled at a second end to lifting block 100. Cable 70 is coupled at a first end to an anchor 150, routed through sheaves 26*a*, 28*a* and 32*c* and coupled at a second end to lifting block 100. Cable 80 is coupled at a first end to an anchor 150, routed through sheaves 30*b* and 32*b* and coupled at a second end to lifting block 100. Cable 90 is coupled at a first end to an anchor 150, routed through sheaves 26*b*, 28*b* and 32*d* and coupled at a second end to lifting block 100.

The sections of cables 70 and 90 extending between sheaves 26*a* and 28*a* and 26*b* and 28*b*, respectively, may be protected by flanges 12*a* of curbs 12.

Figure 7:
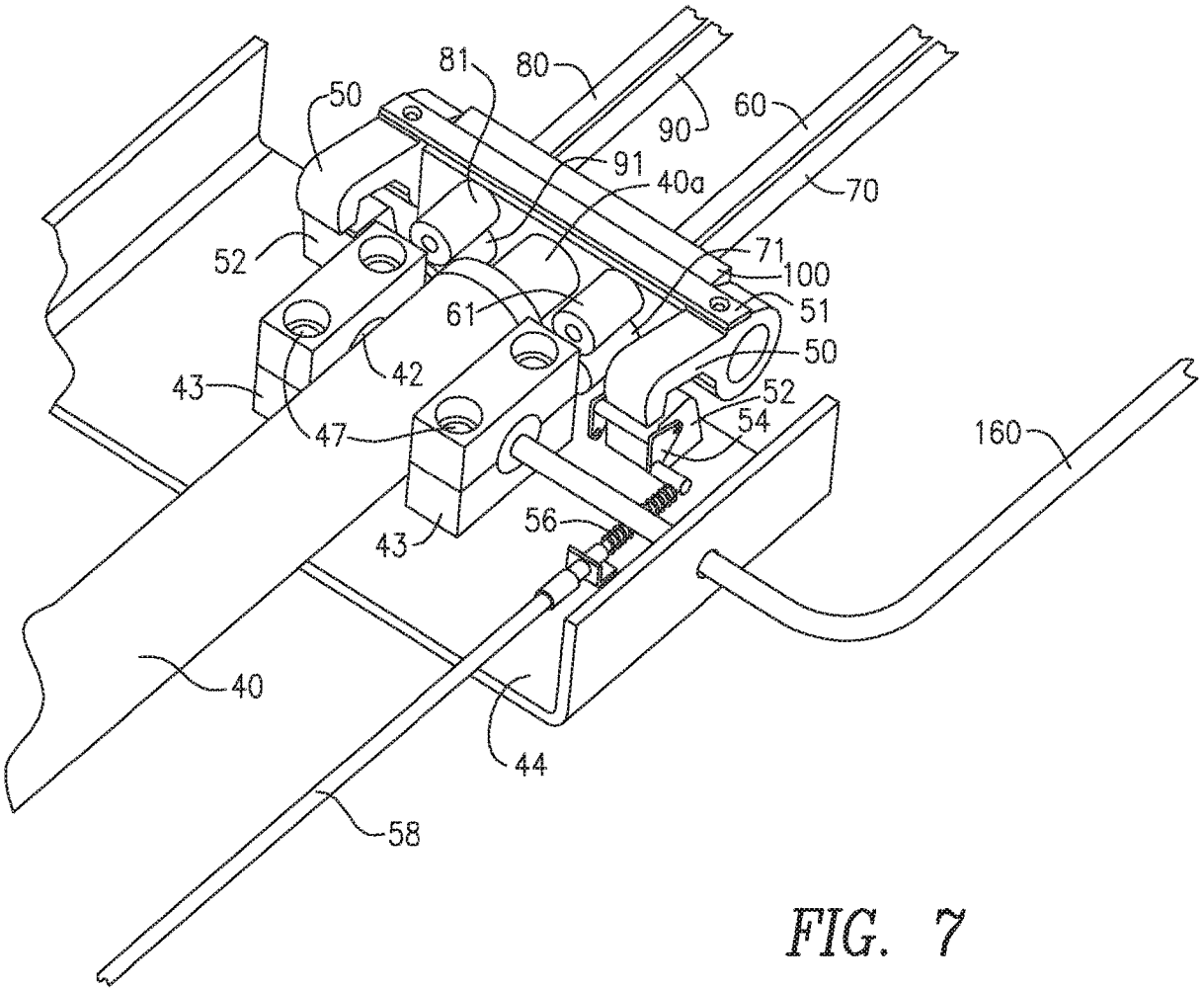
FIG. 7 is an elevated perspective view of a lifting mechanism, lifting block and safety latch assembly in accordance with an embodiment of the present disclosure.

With further reference to FIG. 7, each of cables 60, 70, 80 and 90 are coupled to the lifting block 100 with ferrules 61, 71, 81 and 91, respectively. Another suitable fastening means may be employed as known to those skilled in the art.

Support blocks 43 may be fixed directly to a floor of platform 10 or to a mounting plate 44 for mounting components of the suspension lift apparatus 2. Lifting mechanism 40 is trunnion mounted to support blocks 43. Other means to mount the lifting mechanism may be employed as known to those skilled in the art. In the embodiment shown in FIG. 7 the support blocks 43 are each formed of two pieces and fastened around a projection 42 extending from each side of the lifting mechanism 40 to secure the lifting mechanism 40. Fasteners 47 such as bolts or the like may be used to removably fasten the pieces of the support blocks together, and optionally, to the platform 10 and/or the mounting plate 44 to enable replacement, repair, etc. of the lifting mechanism 40. In one embodiment pipe 160 is coupled to the lifting mechanism 40 via one of the support blocks 43.

Figure 2A:
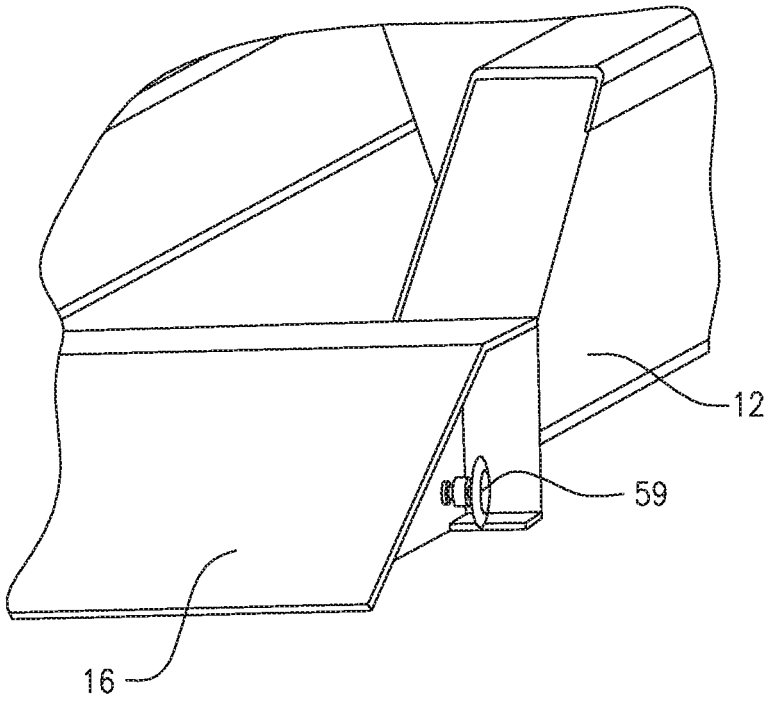
FIG. 2A is a perspective view of detail A of FIG. 2 showing a latch release knob in accordance with an embodiment of the present disclosure.
Figure 8:
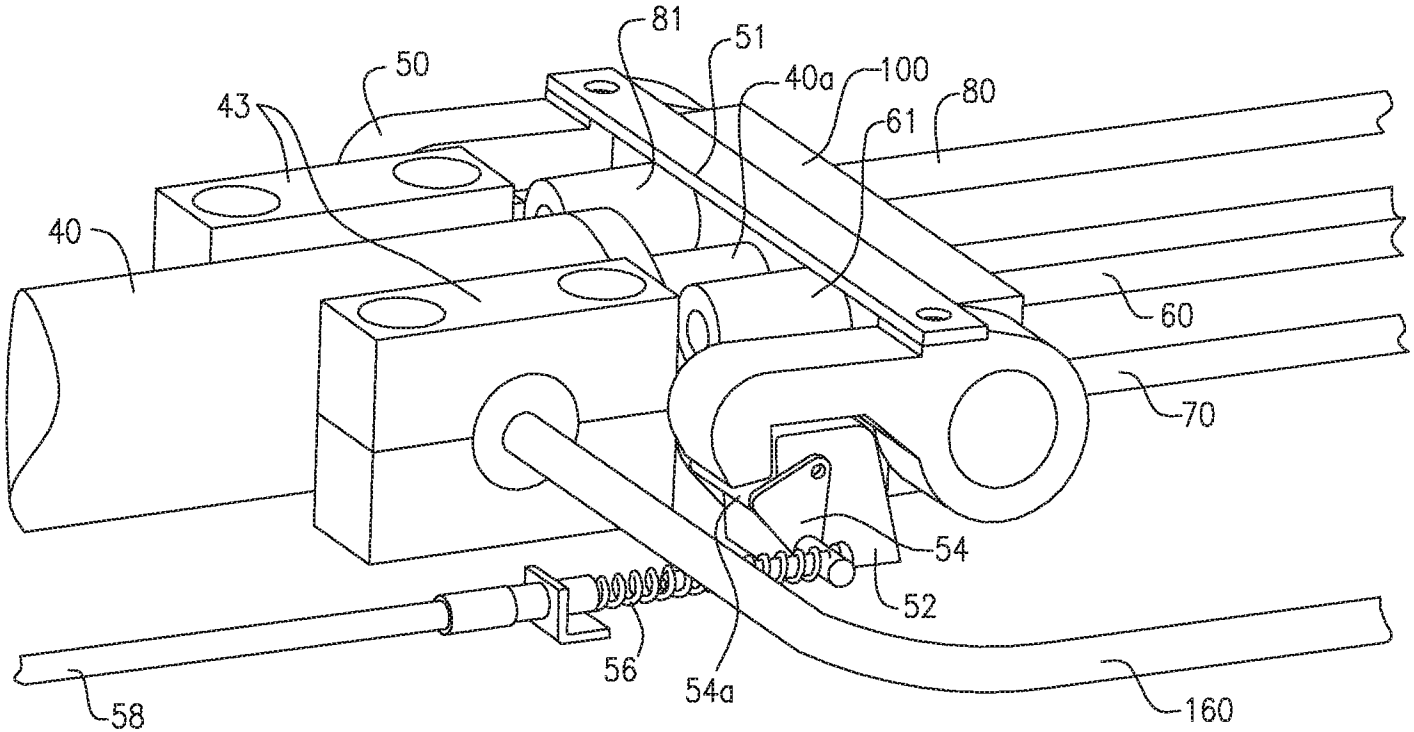
FIG. 8 is an elevated side perspective view of a lifting mechanism, lifting block, safety latch assembly and latch release mechanism of a suspension lift in accordance with an embodiment of the present disclosure.

In accordance with an embodiment, safety latches 50 are pivotably mounted on lifting block 100. A retention plate 51 may be employed to couple the safety latches 50 to ensure coordination of pivotal movement of the safety latches 50. With further reference to FIG. 8, safety latches 50 are sized and configured to engage latch stop blocks 52 to retain the platform 10 in a fully raised position. A latch release mechanism 54 is pivotably coupled to one of the latch stop blocks 52 and to a release cable 58 such as but not limited to a Bowden wire. Release cable 58 is coupled at an opposite end to a latch release knob 59 as shown in FIGS. 2, 2A and 4. The latch release knob is operable to apply a pulling force on the release cable 58 and the latch release mechanism 54, which as shown includes an eccentric portion 54*a* which urges the latch 50 upward to disengage both latches 50 from the latch stop blocks. A spring 56 may be included to provide a biasing force to return the latch release mechanism 54 to the lowered position. In the latched position, the platform is in a fully raised position.

Lifting mechanism 40 includes extension arm 40*a* which is coupled to the lifting block 100 and reciprocally movable in the channel 18 along the long axis of the platform 10 upon actuation of the lifting mechanism 40, once the safety latches 50 are released.

Figure 9:
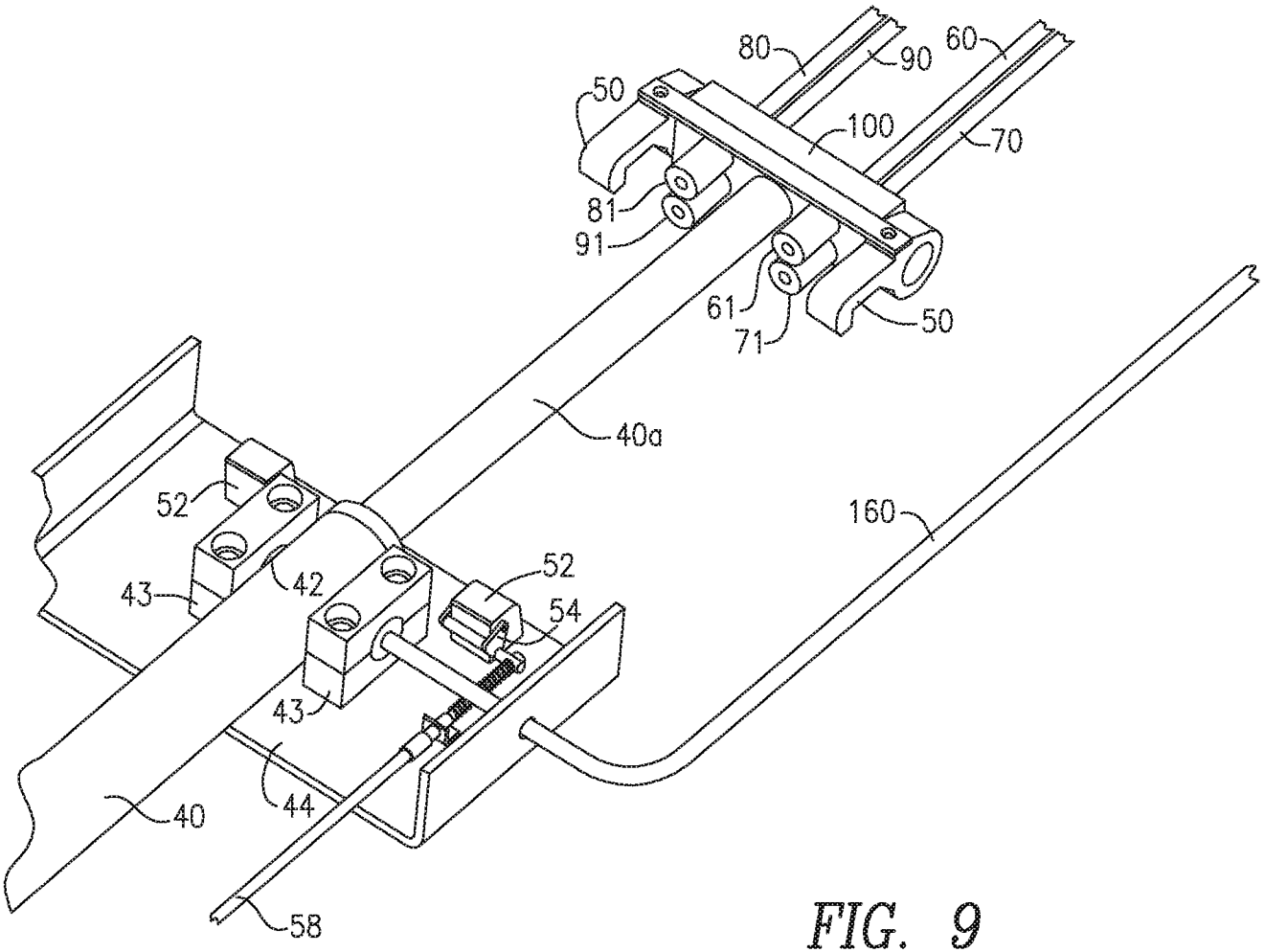
FIG. 9 is an elevated perspective view of the lifting mechanism, lifting block and safety latch assembly of FIG. 7 with a lifting mechanism extension in a partially extended position in accordance with an embodiment of the present disclosure.

With further reference to FIG. 9, release of the safety latches 50 permits movement of the extension arm 40*a* away from the support blocks 43, causing the platform 10 to lower from the raised position as cables 60, 70, 80 and 90 move in concert with the lifting block 100 toward the end plate 19.

The drive-on ramp 16 is disposed at an entrance end of the platform 10 and may have sloped front and back ends so that as a car is driven onto the platform 10 and onto the runways 20 the sloped back end serves as a block to prevent the car rolling off the entrance end of the platform 10. It will be apparent to those skilled in the art that an additional, appropriately configured drive-on ramp may be disposed at the opposite end of the platform 10, i.e., the end having the wheel stop 14, as it may be desirable to accommodate entrance and exit of a car from either end of the platform 10. Such additional drive-on ramp would fit over the wheel stop 14 to ensure no damage to the underlying sheaves and cables.

Cables may be but are not limited ropes, belts or the like, made of suitable materials such as metal, Kevlar, polymer, reinforced polymer, hemp, etc.

The disclosed configuration of the platform 10, including the channel 18 housing the lifting mechanism 40, portions of cables 60, 70, 80 and 90 and safety latch apparatus permits a car to park on the platform 10 with the entire lifting mechanism 40 between the wheel of the car. This configuration advantageously eliminates the need to place these components above, below or adjacent the lift platform 10, saving considerable space. The channel 18 can be any suitable width, constrained only by the space required to form adequately-sized runways 20, it being apparent to the skilled artisan that platforms of various widths and lengths may be employed. The channel 18 and the channel cover 22 may be configured so that its highest height is below the minimum ground clearance of a standard automobile. The height may be higher given the particular application, for example, heavy duty trucks, etc.

The thickness of the platform 10 may be any suitable thickness. In some embodiments the thickness is from about 3 mm to about 10 mm. Employing a minimal platform thickness, such as 2 mm, with the wheels resting on the very bottom of the platform 10, permits a reduction of space between the raised platform 10 and a car parked beneath the platform. In some embodiments the platform 10 has a flat top and bottom surface, for example, with a rectangular or square cross section. This is in contrast to some existing platform floor designs, in which the platform runways are made from a corrugated sheet rather than a flat sheet, and/or other support or lifting members are installed below the platform floor so that the distance from the surface of the platform upon which the wheels rest to the surface that would touch the floor when the platform is lowered, i.e., the effective thickness of the platform, may be as much as 2 inches, or 50 mm. Furthermore, some existing lift platforms include a box constructed of tubular steel members with braces running longitudinally and laterally which requires the rolling surface to be positioned on top of the frame. This type of platform could be as much as 4 inches or about 100 mm thick.

Additionally, in many cases the distance between the floor and some upright obstacle precludes the use of a lift with a thick platform. For example, platforms may be 50 mm thick which often leads to problems. In addition, there is typically some hysteresis in the safety latching mechanism, i.e., when the platform is raised and the latch engages, the platform must be raised at least slightly to relieve the pressure on the safety latch before it can be disengaged. With some parking equipment now in use this amount of hysteresis is significant. By employing a very thin platform and the latch arrangement disclosed herein hysteresis is minimized. Furthermore, the channel cover 22 adds structural stiffness to the platform 10 when securely fastened to the platform 10.

It will be apparent that the cables 60, 70, 80 and 90 may be fixed directly to a ceiling or other structure above the platform 10. For example, one or more of the cables 60, 70, 80 and 90 could be directly swaged to a structure, have ends having loops to hang on an existing hook, or the like.

Figure 10:
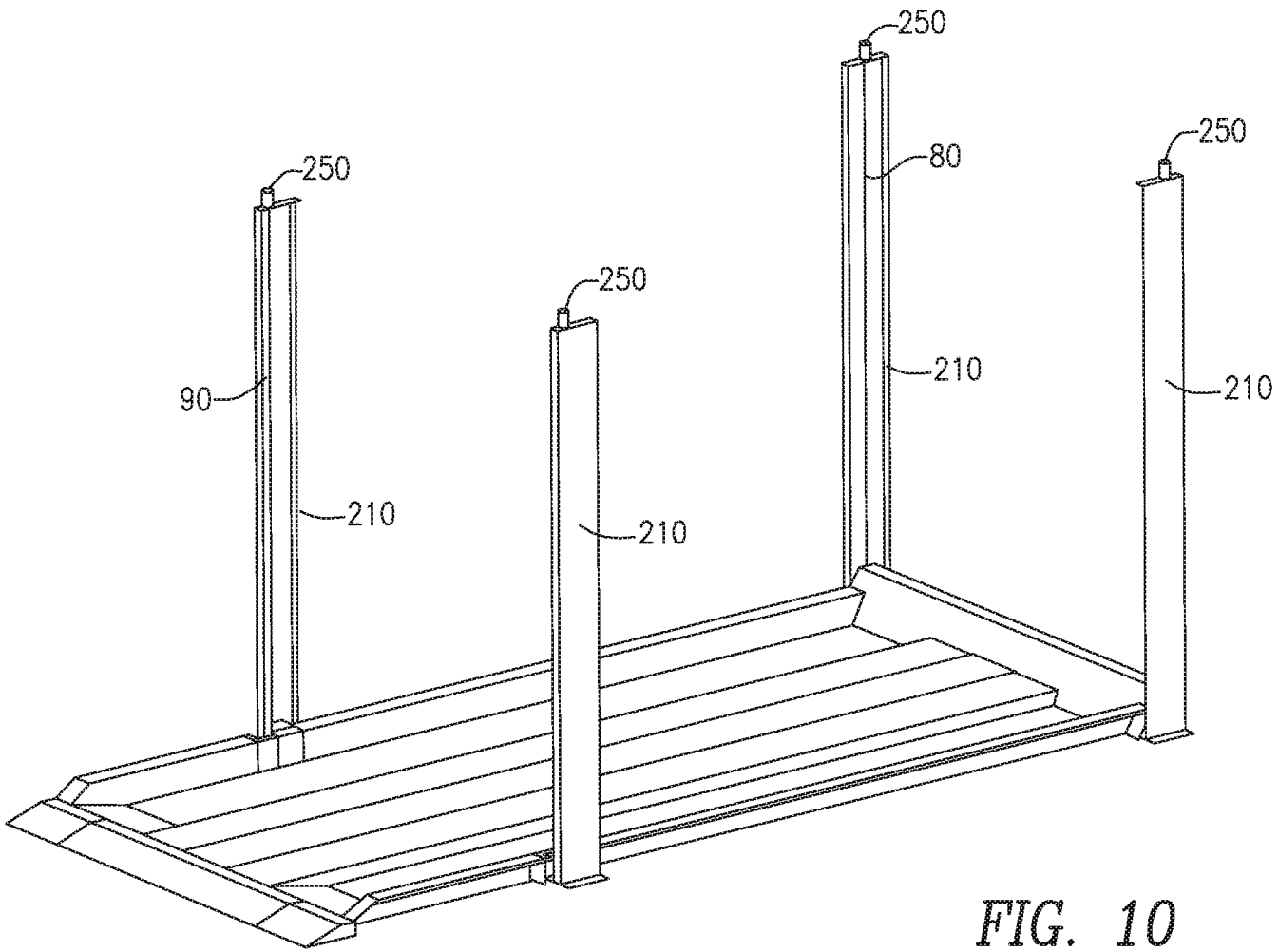
FIG. 10 is a side perspective view of a suspension lift with legs with a platform in a lowered position in accordance with an embodiment of the present disclosure.
Figure 11:
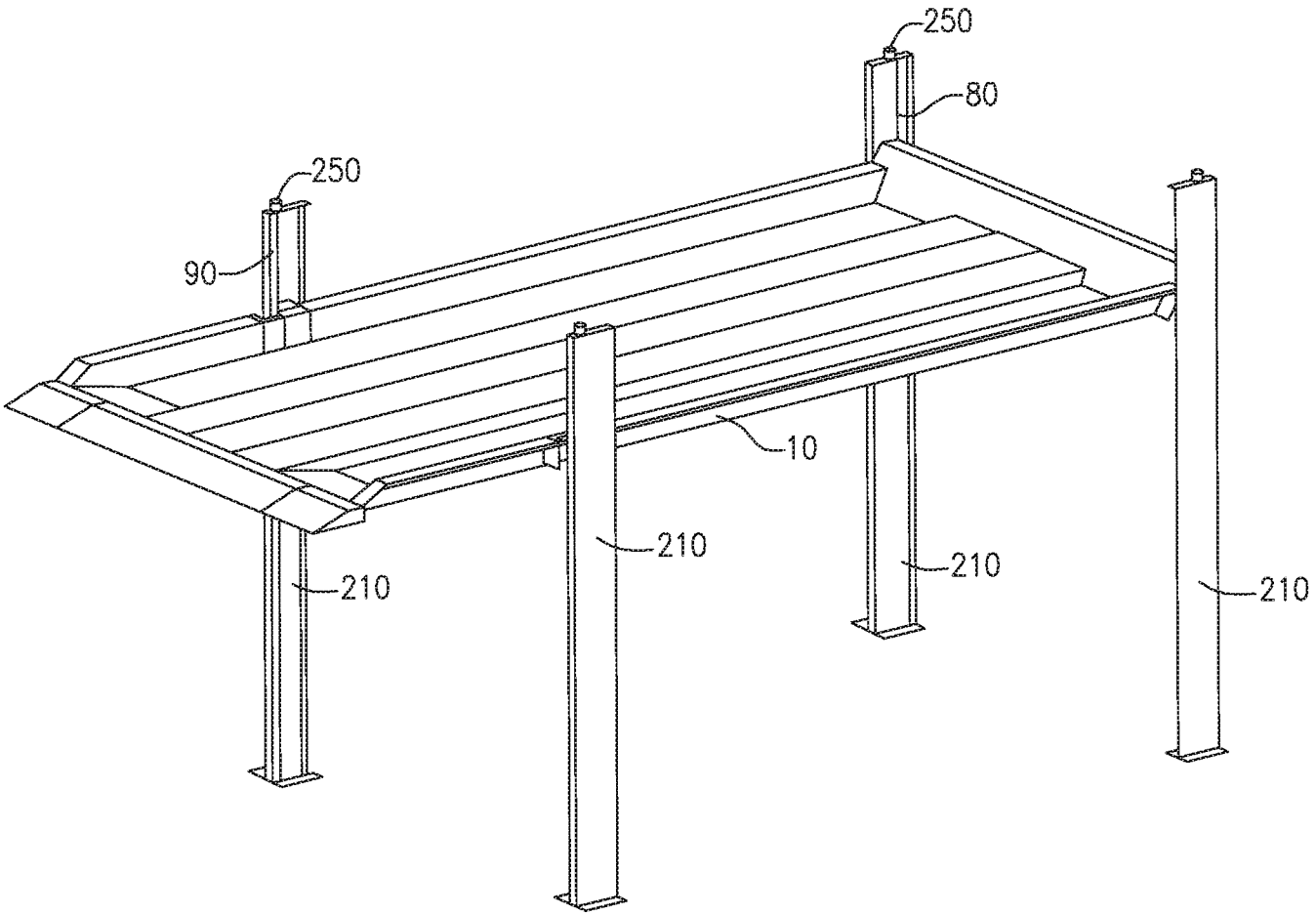
FIG. 11 is a side perspective view of the suspension lift of FIG. 10 with a platform in a raised position in accordance with an embodiment of the present disclosure.
Figure 12:
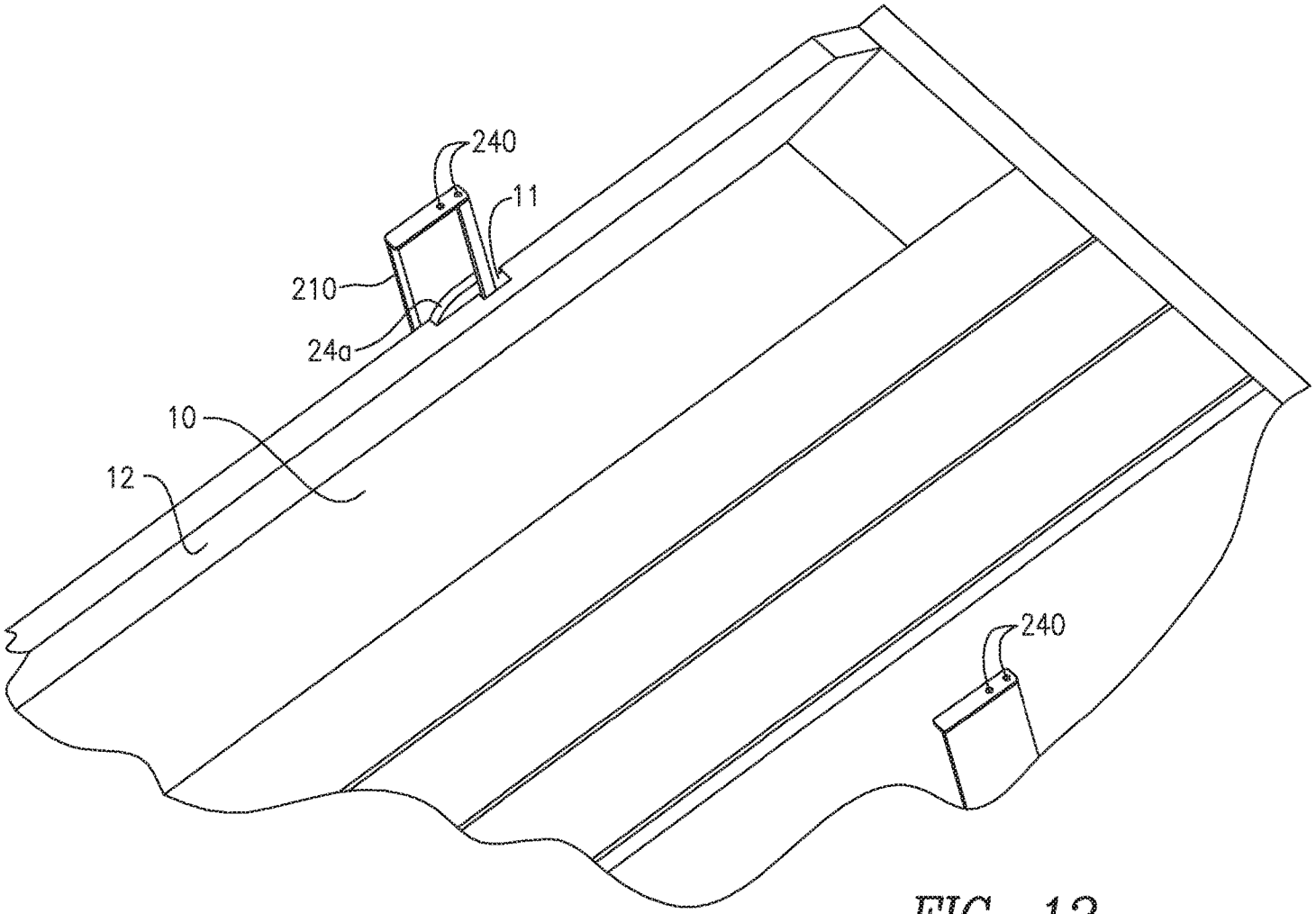
FIG. 12 is an elevated perspective view of a platform and leg arrangement in accordance with an embodiment of the present disclosure.

Now referring to FIGS. 10-12, in other embodiments, when there is no ceiling or other support available to anchor one or more of the cables 60, 70, 80 or 90, the suspension lift 2 may include one or more legs 210 having a base and one or more cable mounts 240 at an end opposite the base. In the embodiment of FIG. 10, cables 80 and 90 are fixed to columns 210 at a top end using button ends 250. The legs 210 may be incorporated into curbs 12 at the periphery of the platform 10 and have a thin profile to conserve space. Platform 10 may include one or more notches 11 to accommodate legs 210. It will be recognized by the skilled artisan that in some instances legs 210 will not be required for all cables. For example, three lifting cables could be attached to overhead attachment points and a single leg employed where no overhead mounting point is available, or other combinations of attachment points and legs. Additionally, the number of cables and number of mounting points and/or legs may vary depending on the size of the platform.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A suspension lift apparatus comprising a vehicle platform comprising a front and rear end, opposing sides between the front and rear end and a central channel formed on the platform along a long axis of the platform, the platform further comprising a first pair of sheaves mounted on opposing sides of the platform vertically with respect to a horizontal plane of the platform and in axial alignment with the long axis of the platform, and positioned between the front and rear ends of the platform; a second pair of sheaves mounted on opposing sides of the platform coplanar with the platform, the second pair of sheaves positioned adjacent the rear end of the platform, a third pair of sheaves mounted at opposing sides of the platform vertically with respect to the horizontal plane of the platform and in axial alignment with a short axis orthogonal to the long axis of the platform, a fourth pair of sheaves mounted adjacent each other at an end of the channel proximate the rear end of the platform, each of the fourth pair of sheaves mounted coplanar with the platform, and a fifth pair of sheaves mounted in axial alignment with the fourth pair of sheaves;

a lifting mechanism coupled to the platform and positioned in the channel in axial alignment therewith; and two pairs of cables, each cable of said pairs of cables coupled at a first end to a first end of the lifting mechanism, wherein one cable of a first pair of cables is routed around one of the fourth pair of sheaves, one of the second pair of sheaves and one of the first pair of sheaves and comprises a second end fixable to a structure above the platform, and the other cable of the first pair is routed around the other of the fourth pair of sheaves, the other of the second pair of sheaves and the other of the first pair of sheaves and comprises a second end fixable to a structure above the platform, and wherein one cable of a second pair of cables is routed around one of the fifth pair of sheaves and one of the third pair of sheaves and comprises a second end fixable to a structure above the platform, and the other of the second pair of cables is routed around the other of the fifth pair of sheaves and the other of the third pair of sheaves and comprises a second end fixable to a structure above the platform.

2. The suspension lift apparatus of claim 1 wherein the lifting mechanism is selected from the group consisting of a hydraulic cylinder jack, mechanical jack, and a motorized jack.

3. The suspension lift apparatus of claim 1, the platform further comprising a cover sized and configured to cover the channel.

4. The suspension lift apparatus of claim 1, wherein one of the first pair of sheaves is mounted to a curb on a first side of the platform and the other of the first pair of sheaves is mounted to a curb on the opposing side of the platform.

5. The suspension lift apparatus of claim 1, the platform further comprising at least one end plate extending vertically with respect to the horizontal plane of the platform and orthogonal to the opposing sides.

6. The suspension lift apparatus of claim 1 wherein each one of the third pair of sheaves is mounted to an end plate extending vertically with respect to the horizontal plane of the platform and orthogonal to the opposing sides.

7. The suspension lift apparatus of claim 1 further comprising a lifting block having a first side coupled to the two pairs of cables and an opposite side coupled to the lifting mechanism.

8. The suspension lift apparatus of claim 1 further comprising at least one latch operable to prevent the lifting mechanism from moving the pairs of cables.

* * * * *